US010161220B2

(12) United States Patent
Getzlaf et al.

(10) Patent No.: US 10,161,220 B2
(45) Date of Patent: Dec. 25, 2018

(54) PLUG-ACTUATED FLOW CONTROL MEMBER

(71) Applicant: NCS MULTISTAGE INC., Calgary (CA)

(72) Inventors: Don Getzlaf, Calgary (CA); John Edward Ravensbergen, Calgary (CA); Brock Gillis, Calgary (CA); Tim Johnson, Calgary (CA)

(73) Assignee: NCS MULTISTAGE INC., Clagary (CA)

( * ) Notice: Subject to any disclaimer, the term of this patent is extended or adjusted under 35 U.S.C. 154(b) by 174 days.

(21) Appl. No.: 15/136,000

(22) Filed: Apr. 22, 2016

(65) Prior Publication Data

US 2016/0341004 A1 Nov. 24, 2016

Related U.S. Application Data

(60) Provisional application No. 62/152,603, filed on Apr. 24, 2015.

(51) Int. Cl.
*E21B 34/14* (2006.01)
*E21B 34/00* (2006.01)

(52) U.S. Cl.
CPC ..... *E21B 34/14* (2013.01); *E21B 2034/007* (2013.01)

(58) Field of Classification Search
CPC ..... E21B 34/14; E21B 2034/007
USPC ..... 166/305.1
See application file for complete search history.

(56) References Cited

U.S. PATENT DOCUMENTS

| | | | |
|---|---|---|---|
| 4,510,995 | A | 4/1985 | Krause, Jr. et al. |
| 4,583,591 | A | 4/1986 | Krause, Jr. et al. |
| 5,309,988 | A | 5/1994 | Shy et al. |
| 6,464,006 | B2 | 10/2002 | Womble |
| 7,150,318 | B2 | 12/2006 | Freeman |
| 7,640,989 | B2 | 1/2010 | Williamson, Jr. et al. |
| 8,006,952 | B2 | 8/2011 | Wygnanski |
| 8,267,178 | B1 | 9/2012 | Sommers et al. |
| 8,297,367 | B2 | 10/2012 | Chen et al. |
| 8,540,019 | B2 | 9/2013 | Hofman et al. |
| 8,607,860 | B2 | 12/2013 | Avant et al. |
| 8,646,537 | B2 | 2/2014 | Tips et al. |
| 8,720,540 | B2 | 5/2014 | Gano |
| 2007/0272411 | A1 | 11/2007 | Lopez De Cardenas et al. |

(Continued)

FOREIGN PATENT DOCUMENTS

| | | | |
|---|---|---|---|
| WO | 2007003597 | A1 | 1/2007 |
| WO | 2011134069 | A1 | 11/2011 |

*Primary Examiner* — Taras P Bemko
(74) *Attorney, Agent, or Firm* — Ridout & Maybee LLP

(57) ABSTRACT

A downhole tool deployable within a wellbore for controlling the supply of treatment to fluid to a reservoir is disclosed. The downhole tool includes a housing defining a passage and a port extending through the housing. The housing includes a seat that is configured for deployment to a plug-receiving position for receiving a plug that is deployed through the passage. A key profile for effecting actuation of the seat to the plug-receiving position in response to registration of the key profile with a matching key on the plug being deployed through the passage is provided. The downhole tool further includes a flow control member configured for displacement relative to the port in response to application of a sufficient net force effected by a fluid pressure differential that is created by supplying pressurized fluid to the passage while the plug is deployed on the seat.

40 Claims, 8 Drawing Sheets

(56) References Cited

U.S. PATENT DOCUMENTS

| | | | |
|---|---|---|---|
| 2009/0151790 | A1 | 6/2009 | Ranjan et al. |
| 2010/0282475 | A1 | 11/2010 | Darnell et al. |
| 2011/0108284 | A1 | 5/2011 | Flores et al. |
| 2011/0240311 | A1 | 10/2011 | Robison et al. |
| 2012/0067583 | A1 | 3/2012 | Zimmerman et al. |
| 2012/0152550 | A1 | 6/2012 | East, Jr. |
| 2012/0325466 | A1 | 12/2012 | Themig |
| 2013/0024049 | A1 | 1/2013 | Yoshioka et al. |
| 2013/0025871 | A1 | 1/2013 | O'Connell et al. |
| 2013/0168099 | A1 | 7/2013 | Themig |
| 2013/0176633 | A1 | 7/2013 | Sun |
| 2013/0264056 | A1 | 10/2013 | Stout |
| 2014/0013801 | A1 | 1/2014 | Ritchie |
| 2014/0034310 | A1 | 2/2014 | Andersen |
| 2014/0151019 | A1 | 6/2014 | Gano |
| 2014/0246208 | A1 | 9/2014 | Themig et al. |
| 2014/0246209 | A1 | 9/2014 | Themig et al. |
| 2015/0060076 | A1 | 3/2015 | Campbell et al. |

PLUG-ACTUATED FLOW CONTROL MEMBER

FIELD

The present disclosure relates to downhole tools which are deployable within a wellbore for controlling supply of treatment fluid to the reservoir.

BACKGROUND

Mechanical actuation of downhole valves can be relatively difficult, owing to the difficulty in deploying shifting tools on coiled tubing, or conventional ball drop systems, for actuating such valves, especially in deviated wellbores. When using conventional ball drop systems, the number of stages that are able to be treated are limited.

BRIEF DESCRIPTION OF DRAWINGS

The preferred embodiments will now be described with the following accompanying drawings, in which.

DETAILED DESCRIPTION

Figure 1:
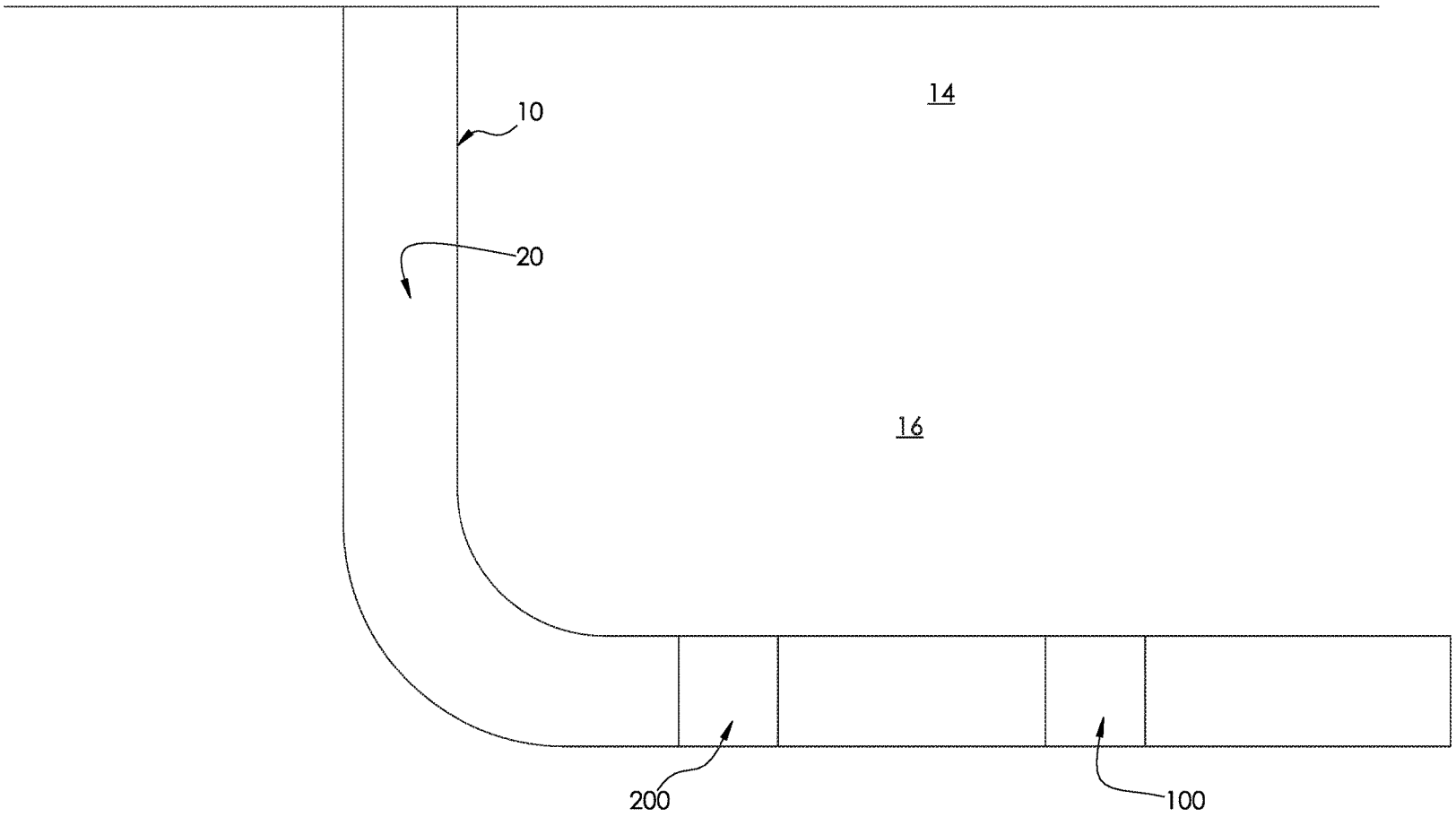
FIG. 1 is a schematic illustration of an embodiment of a system deployed within a wellbore, and employing first and second downhole tools.

Referring to FIG. 1, there is provided a downhole tool 100 for effecting selective stimulation of a subterranean formation 14, such as a reservoir 16. The downhole tool 100 is deployable within a wellbore 10. Suitable wellbores 10 include vertical, horizontal, deviated or multi-lateral wells.

The stimulation is effected by supplying treatment material to the subterranean formation which may include a hydrocarbon-containing reservoir.

In some embodiments, for example, the treatment material is a liquid including water. In some embodiments, for example, the liquid includes water and chemical additives. In other embodiments, for example, the treatment material is a slurry including water, proppant, and chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the treatment material is supplied to effect hydraulic fracturing of the reservoir.

In some embodiments, for example, the treatment material includes water, and is supplied to effect waterflooding of the reservoir.

In some embodiments, for example, the treatment material includes water, and is supplied for transporting (or "flowing", or "pumping") a wellbore tool (such as, for example, a plug) downhole.

The downhole tool 100 may be deployed within the wellbore 10 and integrated within a wellbore string 20 that is disposed within the wellbore 10. Integration may be effected, for example, by way of threading or welding.

The wellbore string 20 may include pipe, casing, or liner, and may also include various forms of tubular segments, such as downhole tools described herein.

Successive downhole tools 100 may be spaced from each other within the wellbore string 20 such that each downhole tool 100 is positioned adjacent a producing interval to be stimulated by fluid treatment effected by treatment material that may be supplied through a port 106 (see below).

Figure 2:
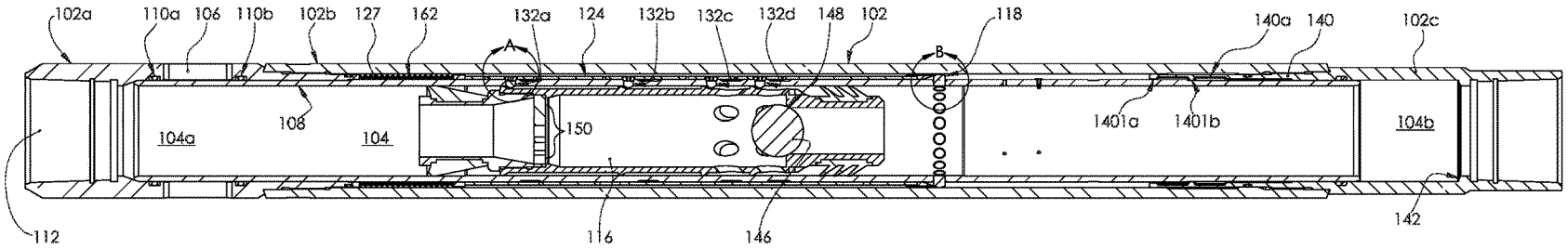
FIG. 2 is a sectional side elevation view of a first downhole tool.

Referring to FIG. 2, in some embodiments, for example, the downhole tool 100 includes a housing 102. In some embodiments, for example, the housing 102 includes interconnected top sub 102A, outer housing 102B, and bottom sub 102C.

The housing 102 is coupled (such as, for example, threaded) to the wellbore string 20. The wellbore string 20 is lining the wellbore. The wellbore string 20 is provided for, amongst other things, supporting the subterranean formation within which the wellbore is disposed. The wellbore string may include multiple segments, and segments may be connected (such as by a threaded connection).

A passage 104 is defined within the housing 102. The passage 104 is configured for conducting treatment material from a supply source (such as at the surface) to a port 106 that is also defined within and extends through the housing 102.

The housing 102 includes a sealing surface configured for sealing engagement with a flow control member 108 (see below). In some embodiments, for example, the sealing surface is defined by sealing members 110A, 110B. In some embodiments, for example, when a flow control member 108 is disposed in a position (the "closed position", see below) corresponding to the closed condition of the port 106, each one of the sealing members 110A, 110B, is, independently, disposed in sealing, or substantially sealing, engagement with both of the housing 102 and the flow control member 108. The sealing, or substantially sealing, engagement effects sealing, or substantial sealing, of fluid communication between the passage 104 and the port 106 (and thereby the wellbore, and, therefore, the subterranean formation 14).

Referring to FIG. 2, in some embodiments, for example, each one of the sealing members 110A, 110B, independently, includes an o-ring. In some embodiments, for example, the o-ring is housed within a recess formed within the housing 102. In some embodiments, for example, each one of the sealing members 110A, 110B, independently, includes a molded sealing member (i.e. a sealing member that is fitted within, and/or bonded to, a groove formed within the sub that receives the sealing member).

The port 106 extends through the housing 102, and is disposed between the sealing surfaces 110A, 110B. In some embodiments, for example, the port 106 extends through the housing 102. During treatment, the port 106 effects fluid communication between the passage 104 and the wellbore 10. In this respect, during treatment, treatment material being conducted from the treatment material source via the passage 104 is supplied to the wellbore 10 through the port 106.

In some embodiments, for example, it is desirable for the treatment material, being supplied to the wellbore 10 through the port 106, be supplied, or at least substantially supplied, within a definite zone (or "interval") of the subterranean formation in the vicinity of the port 106. In this respect, the system may be configured to prevent, or at least interfere, with conduction of the treatment material, that is supplied to one zone of the subterranean formation, to a remote zone of the subterranean formation. In some embodiments, for example, such undesired conduction to a remote zone of the subterranean formation may be effected through an annulus, that is formed within the wellbore, between the casing and the subterranean formation. To prevent, or at least interfere, with conduction of the supplied treatment material to a zone of interval of the subterranean formation that is remote from the zone or interval of the subterranean formation to which it is intended that the treatment material is supplied, fluid communication, through the annulus, between the port and the remote zone, is prevented, or substantially prevented, or at least interfered with, by a zonal isolation material. In some embodiments, for example, the zonal isolation material includes cement, and, in such cases, during installation of the assembly within the wellbore, the casing string is cemented to the subterranean formation, and the resulting system is referred to as a cemented completion.

To at least mitigate ingress of cement during cementing, and also at least mitigate curing of cement in space that is in proximity to the port 106, or of any cement that has become disposed within the port, prior to cementing, the port may be filled with a viscous liquid material having a viscosity of at least 100 $mm^2/s$ at 40 degrees Celsius. Suitable viscous liquid materials include encapsulated cement retardant or grease. An exemplary grease is SKF LGHP 2™ grease. For illustrative purposes below, a cement retardant is described. However, it should be understood, other types of liquid viscous materials, as defined above, could be used in substitution for cement retardants.

In some embodiments, for example, the zonal isolation material includes a packer, and, in such cases, such completion is referred to as an open-hole completion.

In some embodiments, for example, the downhole tool 100 includes the flow control member 108, and the flow control member 108 is positionable, relative to the housing 102, in open and closed positions. The open position of the flow control member 108 corresponds to an open condition of the port 106. The closed position of the flow control member 108 corresponds to a closed condition of the port 106.

In some embodiments, for example, the flow control member 108 includes a sleeve. The sleeve is slideably disposed within the passage 104.

While the downhole tool 100 is disposed within the wellbore 10, in the open position, the flow control member 108 is disposed in the closed position, and disposition of the flow control member 108 in the first position is such that the port 106 is closed. In some embodiments, for example, in the closed position, the port 106 is covered by the flow control member 108, and the displacement of the flow control member 108 effects uncovering of the port 106. In some embodiments, for example, the port 106 is closed, the flow control member 108 prevents, or substantially prevents, fluid flow through the port 106, between the passage 104 and the wellbore 10. In some embodiments, for example, "substantially preventing fluid flow through the port 106" means, with respect to the port 106, that less than 10 volume %, if any, of fluid treatment (based on the total volume of the fluid treatment) being conducted through the passage 104, and across the port 106, is being conducted through the port 106.

The flow control member 108 may be displaced from the closed position to the open position and thereby effect opening of the port 106. Such displacement is effected while the downhole tool 100 is deployed downhole within a wellbore 10 (such as, for example, as part of a wellbore string 20), and such displacement, and consequential opening of the port 106, enables fluid, that is being supplied from the surface, to be discharged through the port 106.

In some embodiments, for example, the flow control member 108 co-operates with the sealing members 110A, 110B to effect opening and closing of the port 106. When the port 106 is disposed in the closed condition, the flow control member 108 is sealingly engaged to both of the sealing surfaces 110A, 110B, and preventing, or substantially preventing, fluid flow from the passage 104 to the port 106. When the port 106 is disposed in the open condition, the flow control member 108 is spaced apart or retracted from at least one of the sealing members (such as the sealing surface 110A), thereby providing a passage 104 for treatment material to be delivered to the port 106 from the passage 104.

The flow control member 108 is configured for displacement, relative to the port 106, from the closed position to the open position in response to application of a sufficient net opening force. When the flow control member 108 is disposed in the closed position, the port 106 is disposed in the closed condition. When the flow control member 108 is disposed in the open position, the port 106 is disposed in an open condition. In some embodiments, for example, the application of a sufficient net opening force is effected by a fluid pressure differential (see below).

In some embodiments, for example, the housing 102 includes an inlet 112. When the port 106 is disposed in the open condition, fluid communication is effected between the inlet 112 and the port 106 via the passage 104. When the port 106 is disposed in the closed condition, sealing, or substantial sealing, of fluid communication, between the inlet 112 and the port 106 is effected.

In some embodiments, for example, a flow control member-engaging collet 140 extends from the housing 102 (and, specifically, the bottom sub 102C), and is configured to releasably engage the flow control member 108 for resisting a change in position of the flow control member 108. In this respect, in some embodiments, for example, the flow control member-engaging collet 140 includes at least one collet finger 140A, and each one of the at least collet finger 140*a* includes tabs 1401*a*, 1401*b* that engages the flow control member 108.

In some embodiments, for example, the flow control member 108 and the flow control member-engaging collet 140 are co-operatively configured so that engagement of the flow control member 108 and the flow control member-engaging collet 140 is effected while the flow control member 108 is disposed in the closed position (the engagement is with the tab 1401*a*) and also when the flow control member 108 is disposed in the open position (in which case the engagement is with the tab 1401*b*). In this respect, while the flow control member 108 is disposed in the closed position, the flow control member-engaging collet 140 is engaging the flow control member 108 such that interference or resistance is being effected to a change in position of the flow control member 108 from the closed position to the open position. In some embodiments, for example, the engagement is such that the flow control member-engaging collet 140 is retaining the flow control member 108 in the closed position, and a sufficient net opening force is required to be applied to the flow control member 108 to release the flow control member 108 from retention by the flow control member-engaging collet 140 and thereby effect opening of the flow control member 108. Also in this respect, while the flow control member 108 is disposed in the open position, the flow control member-engaging collet 140 is engaging the flow control member 108 such that interference or resistance is being effected to a change in position of the flow control member 108 from the open position to the closed position. In some embodiments, for example, the engagement is such that the collet 140 is retaining the flow control member 108 in the open position, and a sufficient net closing force is required to be applied to the flow control member 108 to release the flow control member 108 from retention by the flow control member-engaging collet 140 and thereby effect closing of the flow control member 108. In this respect, the flow control member-engaging collet 140 mitigates inadvertent opening and closing of the flow control member 108.

The housing 102 additionally defines a shoulder 142 to limit downhole displacement of the flow control member 108.

The flow control member 108 is configured for displacement, relative to the port 106, in response to application of a sufficient net force effected by a fluid pressure differential that has been created across the flow control member 108. In some embodiments, for example, the fluid pressure differential is created by supplying the passage 104 with pressurized fluid while a plug 116 is co-operatively disposed within the passage 104 relative to the flow control member 108, such that the created pressure differential is that which is created across the plug 116. In some embodiments, for example, the plug 116 is deployed in sealing, or substantially sealing, engagement with the flow control member 108, such that fluid communication between an uphole space 104*a* of the fluid passage 104 and a downhole space 104*b* of the fluid passage 104 is sealed or substantially sealed, and such that supplying of the pressurized fluid to the passage 104, uphole of the plug 116, effects the creation of a pressure differential across the plug 116 and also, therefore, between the uphole and downhole spaces 104*a*, 104*b*, and such created pressure differential effects application of a net force to the flow control member 108 that is sufficient to urge displacement of the flow control member 108 in a downhole direction (in this case, to effect opening of the port 106).

The plug 116 is fluid conveyable, and may take the form of any shape, such as, for example, a ball or a dart.

In some embodiments, for example, the pressure differential is effected by deploying a plug 116 into the passage 104 such that the plug 116 becomes co-operatively disposed within the passage 104, relative to the flow control member 108, for effecting creation of the pressure differential, while the pressurized fluid is being supplied into the passage 104 uphole of the plug 116. In some embodiments, for example, the pressure differential is effected while the plug 116 is sealingly, or substantially sealingly, disposed within the passage 104. In this respect, while the plug is sealingly, or substantially sealingly, disposed within the first passage 104, and while pressurized fluid is being supplied into the passage 104, uphole of the plug 116, fluid flow, past the first plug, in a downhole direction, is prevented, or substantially prevented, such that the creation of the fluid pressure differential, for effecting the displacement of the first flow control member, is effected. In this respect, in some embodiments, for example, a portion of the external surface of the plug 116 is defined by a resilient material. In the illustrated embodiment, the resilient material is in the form of fins 116*a*. The fins 116*a* function to enable the plug to be conducted downhole through the wellbore string 20, while enabling the sealing, or substantially sealing, disposition of the plug 116 relative to the passage-defining surface 102*a* of the housing 102.

The co-operative disposition of the plug 116 within the passage 104, relative to the flow control member 108, is effected by a seat 118. In this respect, the seating of the plug 116 on the seat 118 effects the co-operative disposition of the plug 116 within the passage 104, relative to the flow control member 108, such that, upon supplying of pressurized fluid to the passage 104, uphole of the seated plug 116, the pressure differential is created that effects application of the net force to the flow control member 108 that is sufficient to urge the flow control member 108 into displacement from the closed position to the open position.

Amongst other things, in order to avoid the use of different sized plugs for effecting fluid treatment of multiple stages through ports whose manner of opening is as above-described, the seat 118, upon which the plug 116 is seated for assuming co-operative disposition relative to the respective flow control member 108, is configured so as to be selectively deployable to a plug-receiving position for receiving a plug 116 being deployed through the passage 104. In this respect, when not so deployed, the seat 118 is disposed in a non-interference position relative to the passage 104, thereby permitting other plugs to be selectively deployed further downhole to effect fluid treatment of zones within the subterranean formation that are disposed further downhole.

Figure 5:
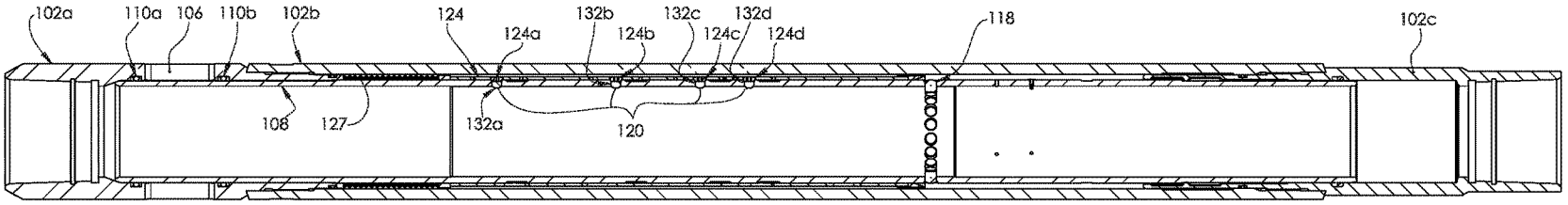
FIG. 5 is another sectional side elevation view of the first downhole tool, with the plug and the biasing member removed for clarity.
Figure 6:
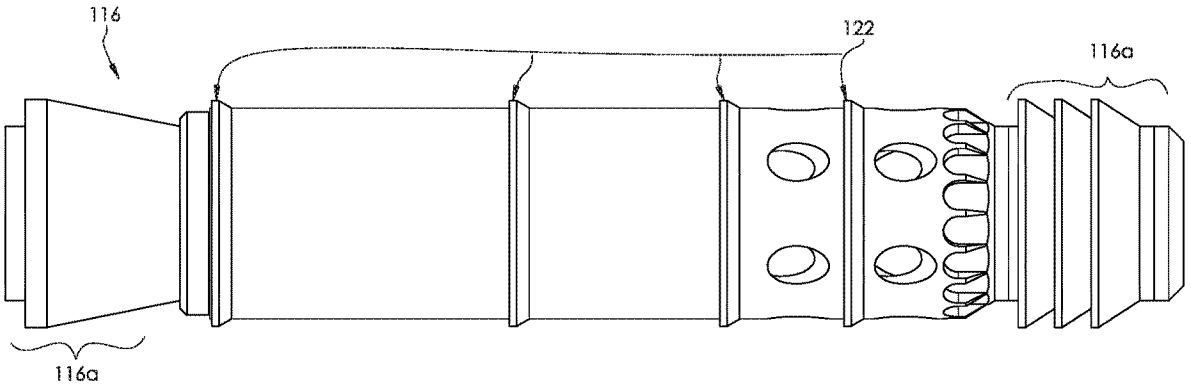
FIG. 6 is a side elevation view of an embodiment of a plug for use with the first downhole tool.
Figure 8:
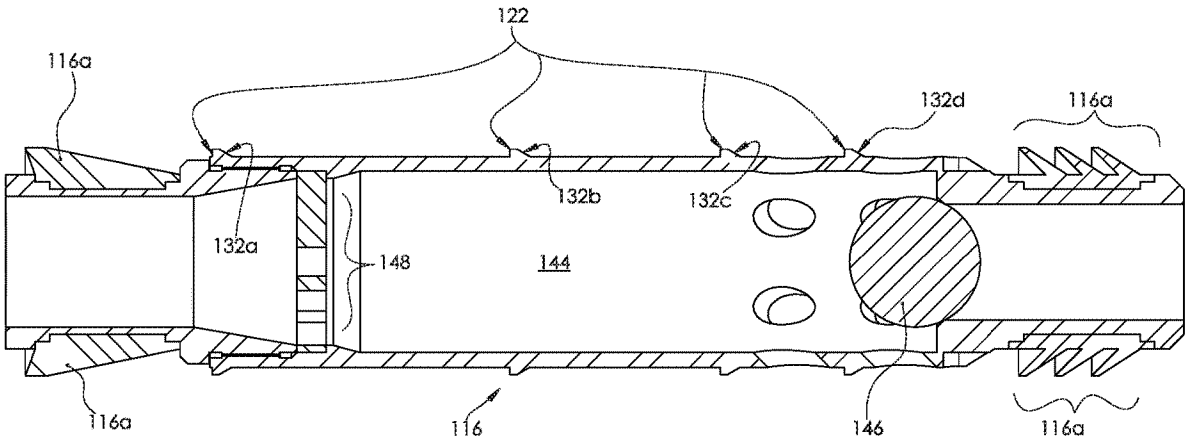
FIG. 8 is a side sectional elevation view of the plug of FIG. 6, taken along lines B-B in FIG. 7.
Figure 7:
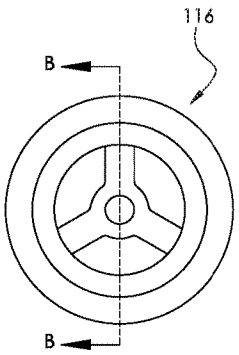
FIG. 7 is an end view of one end of the plug of FIG. 6.

In this respect, and referring to FIG. 5, the downhole tool 100 further includes a key profile 120. The key profile 120 effects actuation (such as, for example, by unlocking) of the seat 118 to the plug-receiving position in response to registration of the key profile 120 with a matching key 122 of the plug 116 being deployed through the passage 104. In some embodiments, for example, the key profile 120 includes a pattern that corresponds to the matching key 122 of the plug 116 being deployed through the passage 104. When the key profile 120 matches a key 122 of a plug 116 (see FIGS. 6 to 8) being conducted through the wellbore string 20 (including through the passage 104), such that the key 122 registers with the key profile 120, the key profile 120 effects the deployment of the seat 118, and the deployment is effected downhole of the key profile 120 and within sufficient time such that the seat 118 is deployed prior to the plug 116 (having the matching key 122) having reached the position within the passage 104 at which the seat 118 becomes deployed. In this respect, the deployed seat 118 catches the plug 116 such that the seat 116 becomes seated on the seat 118. When the key profile 120 does not match a key 122 of a plug 116, then the actuation is not effected, and the plug 116 continues passing downhole, and, in some embodiments, to the next downhole tool, disposed further downhole, relative to the downhole tool 100 (where matching of the key profile 120 to the key 122 of the plug 116 was not successful).

Figure 3:
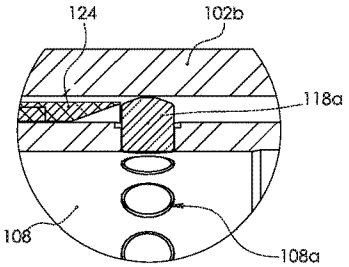
FIG. 3 is a detailed view of Detail "B" in FIG. 2.

Referring to FIG. 3, in some embodiments, for example, the seat 118 is retained in an undeployed position (in a position of non-interference with respect to the passage 104, such that a plug 116, being conducted downhole, is permitted to pass the seat 118, in the undeployed position, and proceed downhole relative to the seat 118), and the actuation of the seat 118 to the plug-receiving position includes releasing of the seat 118 from such retention. In this respect, in some embodiments, for example, the seat 118 is retained in the undeployed position by a tie pin 134 (see FIG. 9). In some embodiments, for example, the seat 118 is in the form of a plurality of seat pins 118*a* that are extendible to the plug-receiving position through corresponding apertures 108*a* provided in the flow control member 108, and the tie pin 134 extends through each one of the seat pins 118*a* and encircles the flow control member 108. In some embodiments, retention of the seat 118 in the undeployed position is also maintained by positioning the seat 118, in the undeployed position, immediately next to an internal surface of the housing 102, thereby maintaining the seat pins 118*a* in position for being actuated into deployment by the seat actuator 124 (see below), which, in concert, effects the shearing of the tie pin 134.

Figure 4:
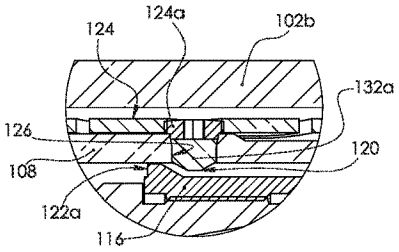
FIG. 4 is a detailed view of Detail "A" in FIG. 2.

Referring to FIG. 4, in some embodiments, for example, the downhole tool 100 further includes a seat actuator 124 and a seat actuator retainer 126. The seat actuator 124 functions to effect deployment of the seat 118. In the illustrated embodiment, the seat actuator 124 is in the form of a sleeve. The seat actuator retainer 126 functions to retain the seat actuator 124 until the key profile 120 matches the key 122 of a plug 116 that is passing by the key profile 120 while being conducted downhole through the wellbore string 20. In the illustrated embodiment, the flow control member 108 also functions as the seat actuator retainer 126. In response to the matching of the key 122 with the key profile 120, the seat actuator 124 is released from retention by the seat actuator retainer 126, such that the seat actuator 124 effects the deployment of the seat 118.

In some embodiments, for example, the seat actuator 124 is biased towards a seat actuation position for urging the deployment of the seat 118. In this respect, upon the releasing of the seat actuator 124 from retention by the seat actuator retainer 126, the biasing effects the displacement of the seat actuator 124 to the seat actuation position such that the deployment of the seat 118 is effected. In some embodiments, for example, the biasing is effected by a biasing member 162, such as a compressed spring stack that is housed within a space 127 between the flow control member 108 in region 108*b*, see FIG. 9) and an internal surface of the housing 102, and is pressing against the seat actuator 124.

Figure 9:
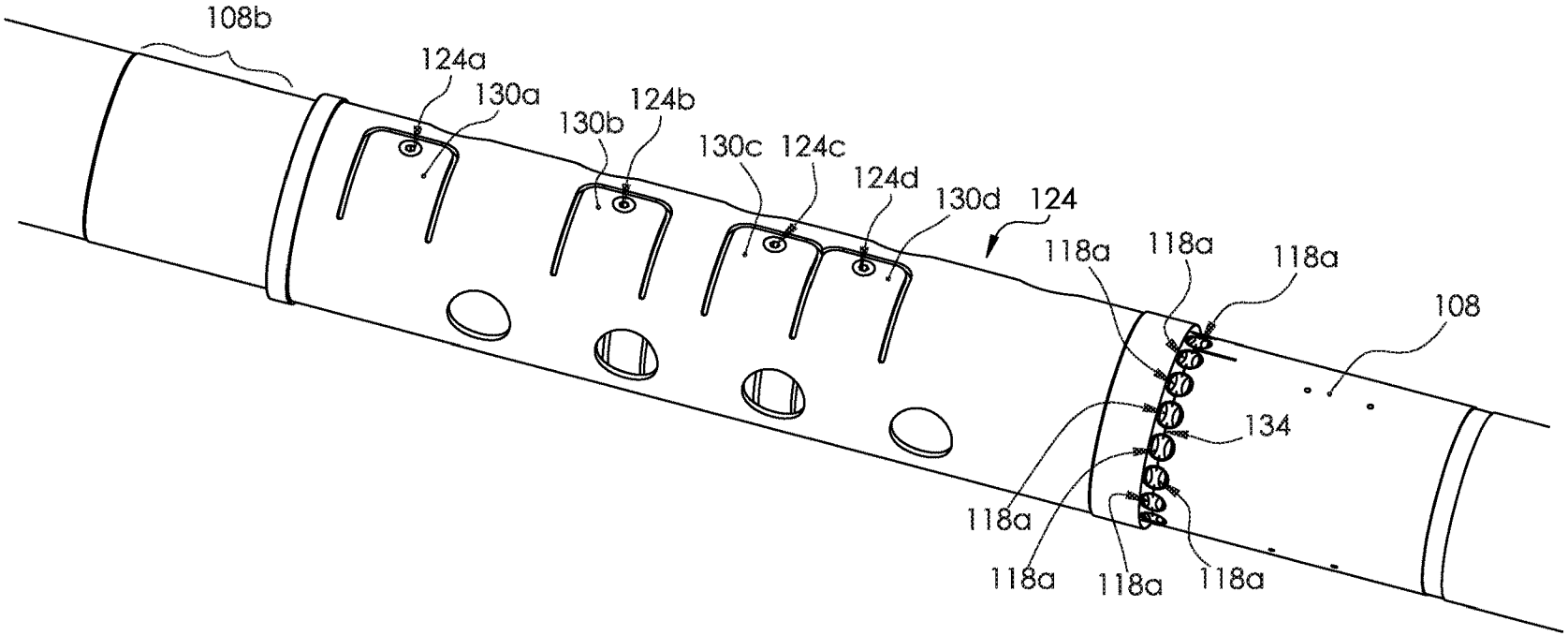
FIG. 9 is a top perspective fragmentary view of the first downhole tool, with the housing removed for clarity.
Figure 10:
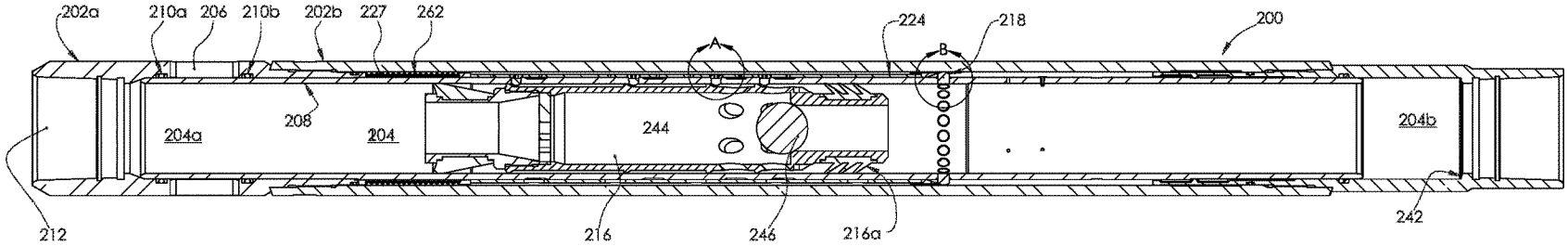
FIG. 10 is a sectional side elevation view of a second downhole tool.
Figure 12:
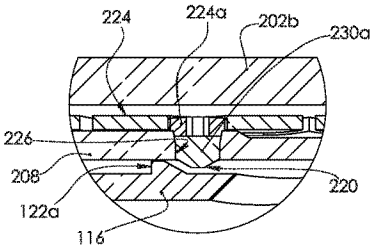
FIG. 12 is a detailed view of Detail "A" in FIG. 10.
Figure 11:
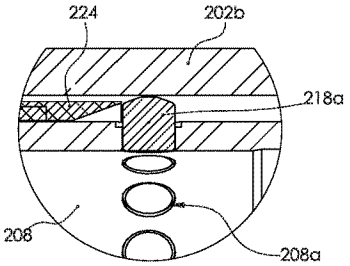
FIG. 11 is a detailed view of Detail "B" in FIG. 10.

Referring to FIGS. 4 and 9, in some embodiments, for example, the seat actuator 124 includes one or more retainable portions 124*a*, 124*b*, 124*c*. 124*d* (four are shown). The registration of the matching key 122 with the key profile 120 effects relative displacement between: (i) all of the one or more retainable portions 124*a*, 124*b*, 124*c*. 124*d*, and (ii) the seat actuator retainer 126. The relative displacement is such that the releasing of the seat actuator 124 from retention by the seat actuator retainer 126 is effected, such that the seat actuator 124 becomes displaceable to the seat actuation position for effecting the deployment of the seat 118 to the plug-receiving position for receiving a plug 116 being deployed through the passage 104. In some embodiments, for example, the releasing of all of the retainable portions 124*a*, 124*b*, 124*c*. 124*d* is effected simultaneously or substantially simultaneously.

In some embodiments, for example, each one of the one or more retainable portions 124*a*, 124*b*, 124*c*. 124*d* independently, is displaceable between a retained position and a released position. For each one of the one or more retainable portions 124*a*, 124*b*, 124*c*. 124*d*, in the retained position, the retainable portion is retained by the seat actuator retainer 126. In the released position, the retainable portion is released from the seat actuator retainer 126.

In this respect, the deployment of the seat 118 is prevented by the retention of at least one of the one or more retainable portions 124*a*, 124*b*, 124*c*. 124*d* by the seat actuator retainer 126. In other words, retention of only one of the one or more retainable portions 124*a*, 124*b*, 124*c*. 124*d* is sufficient for the seat actuator 124 to be prevented from effecting deployment of the seat 118. In this respect also, the seat actuator 124 becomes released from retention by the seat actuator retainer 126, and becomes displaceable to effect the deployment of the seat 118 once all of the one or more retainable portions 124*a*, 124*b*, 124*c*. 124*d* become disposed in their respective released positions.

In some embodiments, for example, each one of the one or more retainable portions 124*a*, 124*b*, 124*c*. 124*d*, independently, is biased towards its respective retained position. In some embodiments, for example, each one of the retainable portions 124*a*, 124*b*, 124*c*. 124*d*, independently, is integral to corresponding leaf spring portions 130*a*, 130*b*, 130*c*, 130*d* that have been formed from the cutting of a portion of the seat actuator 124. In the illustrated embodiments, for example, each one of retainable portions 124*a*, 124*b*. 124*c*, 124*d* is in the form of a pin that is attached to the top surface of the seat actuator 124. In order for all of the retainable portions 124*a*, 124*b*, 124*c*. 124*d* to be displaced to their respective released positions, it is necessary to apply sufficient force to the retainable portions 124*a*, 124*b*, 124*c*. 124*d* to effect displacement to their respective released positions. In this respect, the key profile 120 is configured to transmit, to the one or more retainable portions 124*a*, 124*b*, 124*c*. 124*d*, a force applied by the plug 116 while the registration of the matching key 122 with the key profile 120 is being effected, where such force is sufficient to effect displacement of the retainable portions 124*a*, 124*b*, 124*c*. 124*d* to their respective released positions. In order to maintain the key profile 120 in a position for registering with a matching key 122 of a plug 116 being deployed through the wellbore string 20, the key profile 120 is biased towards this position. In this respect, in some embodiments, for example, the biasing of the retainable portions 124*a*, 124*b*, 124*c*. 124*d* also effects the biasing of the key profile 120 into a position for registering with a matching key 122 of a plug 116 being deployed through the wellbore string 20.

In some embodiments, for example, the downhole tool 100 includes a releasing actuator 132. The releasing actuator 132 including a plurality of releasing actuator members 132*a*, 132*b*, 132*c*, 132*d*. In the illustrated embodiments, each one of the releasing actuator members 132*a*, 132*b*, 132*c*, 132*d* is in the form of pins. Each one of the releasing actuator members 132*a*, 132*b*, 132*c*, 132*d*, independently, corresponds to a respective one of the retainable portions 124*a*, 124*b*, 124*c*. 124*d*. As discussed above, each one of the retainable portions 124*a*, 124*b*, 124*c*. 124*d*, independently, is displaceable between the retained position and the released position. Each one of the retainable portions 124*a*, 124*b*, 124*c*. 124*d*, independently, is displaceable from its respective retained position to its respective released position, in response to transmission, by the respective releasing actuator member 132*a*, 132*b*, 132*c*, 132*d*, of a force being applied from within the passage to the respective releasing actuator member. Registration of all of the releasing actuator members 132*a*, 132*b*, 132*c*, 132*d*, with a matching key 122 of a plug 116 being deployed through the wellbore string 20, results in the receiving of a force, applied by the plug 116, by each one of the releasing actuator members 132*a*, 132*b*, 132*c*, 132*d*. Such received force is transmitted by each one of the releasing actuator members 132*a*, 132*b*, 132*c*, 132*d* to a respective one of the retainable portions 124*a*, 124*b*, 124*c*.

124*d*, such that displacement of the respective retainable portion is effected, and such that each one of retainable portions 124*a*, 124*b*, 124*c*. 124*d*, independently, becomes disposed in its respective released position. In this respect, in some embodiments, for example, the key profile 120 is defined by the releasing actuator members 132*a*, 132*b*, 132*c*, 132*d*. In some embodiments, for example, the key profile 120 is defined by the relative spacing between the releasing actuator members 132*a*, 132*b*, 132*c*, 132*d*. In this respect, the matching key 122 of the plug 122 includes ribs 122*a*, 122*b*, 122*c*, 122*d* that match with the releasing actuator members 132*a*, 132*b*, 132*c*, 132*d*, such that as the plug 122 is conducted past the key profile 120, the ribs 122*a*, 122*b*, 122*c*, 122*d* register with (such as by engaging) the releasing actuator members 132*a*, 132*b*, 132*c*, 132*d*, such that all of the releasing actuator members 132*a*, 132*b*, 132*c*, 132*d* are displaced to effect the releasing of all of the retainable portions 124*a*, 124*b*, 124*c*. 124*d*. In some embodiments, for example, the releasing of all of the retainable portions 124*a*, 124*b*, 124*c*. 124*d* is effected simultaneously or substantially simultaneously. This releasing is with effect that the seat actuator 124 becomes released from retention by the seat actuator retainer 126, such that the seat actuator 124 becomes displaceable to the seat actuation position for effecting the deployment of the seat 118 to the plug-receiving position for receiving a plug 116 being deployed through the passage 104. In some embodiments, for example, the displacing of all of the releasing actuator members 132*a*, 132*b*, 132*c*, 132*d* is effected simultaneously or substantially simultaneously.

In some embodiments, for example, and as discussed above with respect to the key profile 120, the biasing of the retainable portions 124*a*, 124*b*, 124*c*. 124*d* also effects the biasing of the releasing actuator members 132*a*, 132*b*, 132*c*, 132*d* (the biasing of the retainable portion 124*a* also effects the biasing of the respective releasing actuator member 132*a*, etc.) into positions for registering with a matching key 122 of a plug 116 being deployed through the wellbore string 20. In some embodiments, for example, for each one of the releasing actuator members 132*a*, 132*b*, 132*c*, 132*d*, one end extends through passages 108*a*, 108*b*, 108*c*, 108*d* of the flow control member 108, such that such ends define the key profile 120 and are positioned for registering with a matching key 122 of a plug 116 being deployed through the wellbore string 20. Similarly, in some embodiments, for example, in their retained positions, the retainable portions 124*a*, 124*b*, 124*c*. 124*d* are also disposed within the passages 108*a*, 108*b*, 108*c*, 108*d*, such that, in such embodiments, the flow control member 108 functions also as the seat actuator retainer 126.

Referring to FIGS. 1 and 10 to 12, a second downhole tool 200 may be incorporated within the wellbore string 20 with the downhole tool 100 (or, the "first downhole tool 100"), and disposed uphole relative to the first downhole tool 100. The second downhole tool 200 includes a seat 218 that is deployable to a plug-receiving position for receiving a second plug 216 being deployed through the wellbore string 20, which corresponds to the configuration of the first downhole tool 100. In this respect, parts of the second downhole tool 200 that are alike with parts of the first downhole tool 100 are labelled using the same reference numeral incremented by "100". With the exception of the key profile, the second downhole tool 200 is identical, or substantially identical, to the first downhole tool 100. The first key profile 120 of the first downhole tool 100 is co-operatively configured with the second key profile 220 of the second downhole tool 200 such that the key 122 of the first plug 116 matches the first key profile 120 but does not match the second key profile 220 such that the first plug 120 is deployable past the second downhole tool 200 without effecting deployment of the second seat 218. The first plug is, therefore, conductible further downhole, to the first downhole tool 100, such that the key 122 of the first plug 116 becomes registered with the first key profile 120, and thereby effects deployment of the first seat 118 such that the first seat 118 becomes positioned for receiving the first plug 116, and the first plug 116 becomes seated on the first seat 118 once the first plug 116 reaches the first seat 118.

It is understood that additional downhole tools may be incorporated within the wellbore string 20, and that such additional downhole tools may be identical, or substantially identical, to the first or second downhole tools 100, 200, with the exception that the key profile of each one of the downhole tools is different.

In another aspect, a kit may also be provided, and include the first and second downhole tools 100, 200, and also include the first and second plugs 116, 216. For at least one of the first and second plugs 116, 216, the key 122 (222) of one plug 116 (216) does not match the key profile 220 (120) to which the other plug 216 (116) is registerable with, such that, for at least one of the first and second plugs 116, 216, the plug 116 (216) is deployable through the passage 204 (104) of the downhole tool 200 (100) with the non-matching key profile 220 (120) without effecting deployment of the seat 218 (118) of the downhole tool 200 (100) with the non-matching key profile 220 (120). It is understood that additional downhole tools may be incorporated within the kit, and that such additional downhole tools may be identical, or substantially identical, to the first or second downhole tools 100, 200, with the exception that the key profile of each one of the downhole tools is different.

An exemplary process for supplying treatment fluid to a subterranean formation, through a wellbore string 20, disposed within a wellbore, and incorporating any one of the above-described embodiments of the downhole tool apparatus 100, will now be described.

Figure 13:
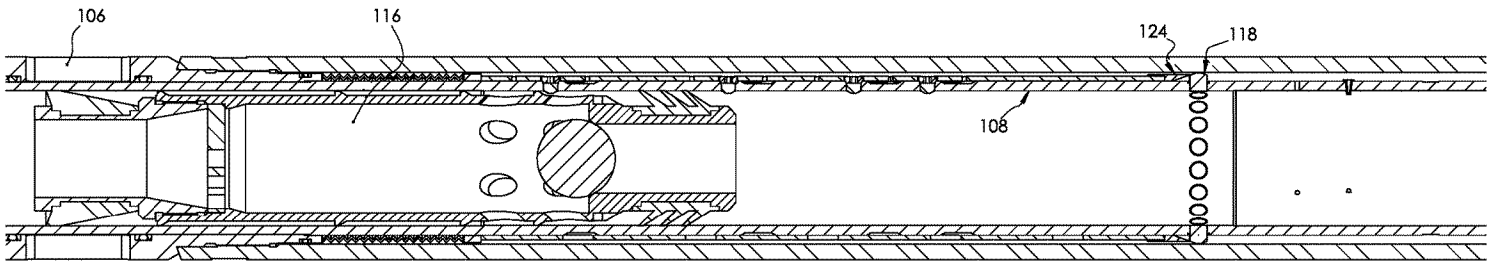
FIGS. 13 to 17 illustrate the various positions of the plug as it is being conducted downhole through the first downhole tool that is disposed within a wellbore.
Figure 14:
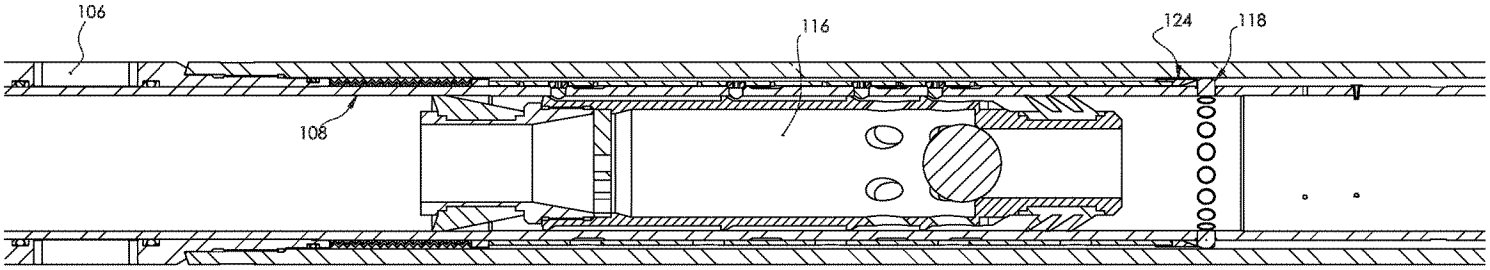
Figure 15:
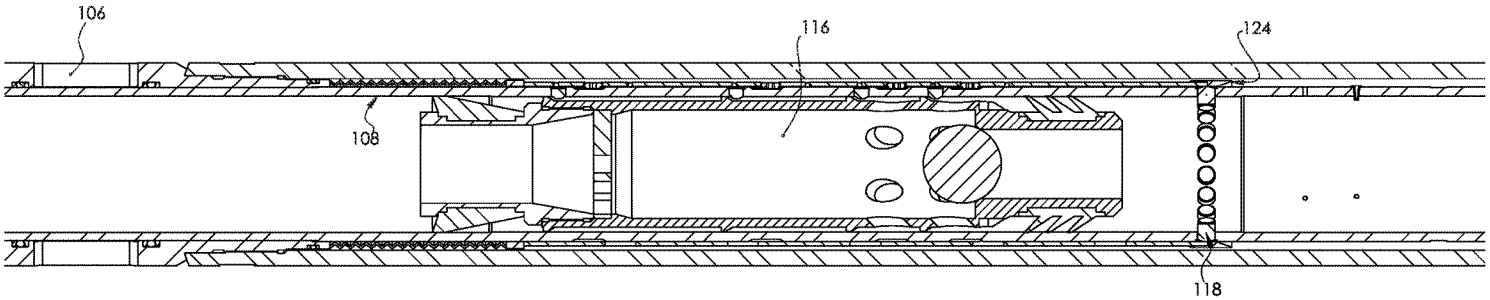
Figure 16:
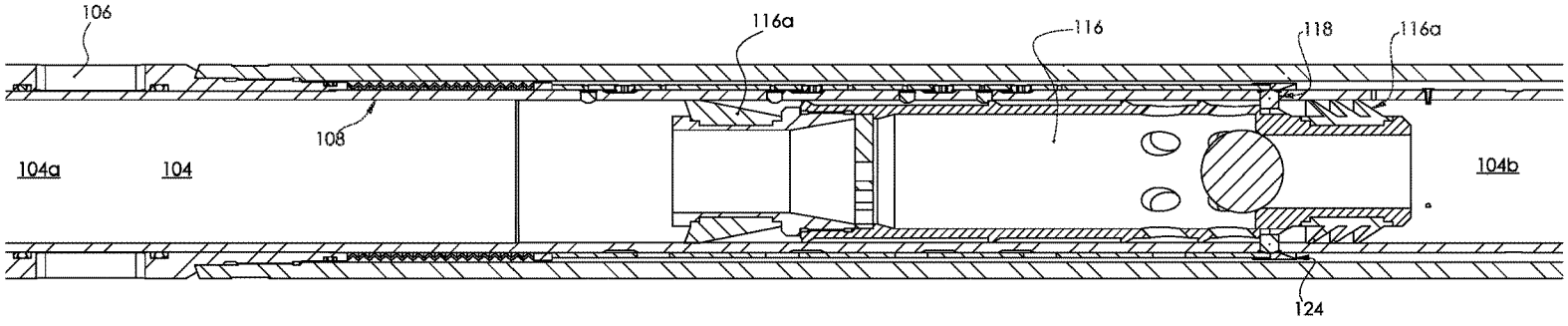
Figure 17:
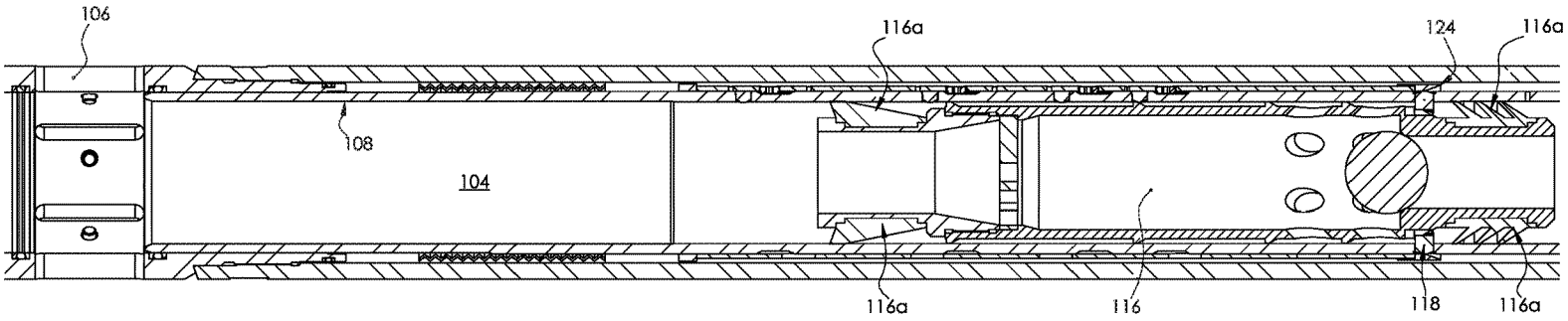

The first plug 116 is conducted downhole (such as being pumped with flowing fluid) through the wellbore string 20 including the first and second downhole tools 100, 200, as described above (see FIG. 13). The plug 116 passes the downhole tool 200, and, eventually, the plug 116 reaches a position such that the plug key 122 matches the profile 120 (see FIG. 14), thereby effecting deployment of the first seat 114 (see FIG. 15). The plug 116 continues being conducted further downhole until it lands onto the deployed seat 118 (see FIG. 16). Importantly, the first plug 116 has passed the downhole tool 200 without having effected deployment of the second seat 218. Pressurized fluid is supplied uphole of the seated first plug 116 such that the first flow control member 108 becomes displaced to the open position (see FIG. 17). Treatment fluid is then supplied to the subterranean formation through the first port 106. The second plug 216 is then conducted downhole (such as being pumped with flowing fluid) through the wellbore string 20, such that the second seat 218 becomes deployed and the second plug 216 becomes seated on the second seat 218. Pressurized fluid is then supplied uphole of the seated second plug 216 such that the second flow control member 208 becomes displaced to the open position. Treatment fluid is then supplied to the subterranean formation through the second port 206.

After the subterranean formation has been sufficiently treated with treatment fluid, in accordance with the process as above-described, it is desirable to effect flow back and, therefore, production of the hydrocarbon material from the reservoir of the subterranean formation. In some embodiments, for example, in order to effect flowback, the plugs 116, 216 may be drilled out, thereby creating fluid communication between the open ports 106, 206 and the wellhead. In other embodiments, for example, the plug 116 may be suitable designed to enable flowback. In this respect, in some embodiments, for example, the plug 116 includes a selectively openable fluid passage 144 for effecting fluid flow within the first passage, across the first plug, in an uphole direction, in response to a downhole fluid pressure, acting on the plug 116, sufficiently exceeding an uphole fluid pressure, acting on the plug. In some embodiments, for example, the selectively openable fluid passage 144 includes a one-way valve 146. In the illustrated embodiment, the one-way valve 146 includes a ball that is trapped between a valve seat 148 (upon which the ball is configured to seat as pressurized fluid is being supplied hole of the valve seat 148), and a perforated retainer 150, and is moveable between these two features during flowback. In this respect, such plug 116 enables fluid pressurization, to effect opening of the port 106, by blocking downhole flow of supplied pressurized fluid, while also enabling flowback of produced hydrocarbon material after the subterranean formation has been treated by the treatment fluid.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A downhole tool comprising:

a housing;

a passage disposed within the housing;

a seat configured for deployment to a plug-receiving position for receiving a plug being deployed through the passage;

a key profile for effecting actuation of the seat to the plug-receiving position in response to registration of the key profile with a matching key of the plug being deployed through the passage;

a port extending through the housing; and a flow control member configured for displacement, relative to the port, in response to application of a sufficient net force effected by a fluid pressure differential that is created by supplying pressurized fluid to the passage while the plug is seated on the seat, wherein the displacement of the flow control member is from a closed position to an open position;

wherein the seat includes:

a seat actuator; and a seat actuator retainer;

wherein the seat actuator is releasable from retention by the seat actuator retainer in response to the registration of the matching key with the key profile, such that the seat actuator effects the deployment of the seat; and the seat actuator includes one or more retainable portions, and registration of the matching key with the key profile effects relative displacement between: (i) all of the one or more retainable portions, and (ii) the seat actuator retainer, such that the releasing of the seat actuator from retention by the seat actuator retainer is effected; and wherein the key profile is configured to transmit, to the one or more retainable portions, a force applied by the plug while the registration of the matching key with the key profile is being effected;

and wherein each one of the one or more retainable portions, independently, is biased towards its respective retained position;

and wherein, for each one of the one or more retainable portions, the biasing of the retainable portion also effects biasing of the key profile into a position for registering with the matching key of the plug being deployed through the passage.

2. The downhole tool as claimed in claim 1;

wherein each one of the one or more retainable portions, independently, is displaceable between a retained position and a released position, wherein, for each one of the one or more retainable portions, in the retained position, the retainable portion is retained by the seat actuator retainer, and wherein, in the released position, the retainable portion is released from the seat actuator retainer;

such that the deployment of the seat is prevented by the retention of at least one of the one or more retainable portions by the seat actuator retainer;

and such that the seat actuator becomes released from retention by the seat actuator retainer and becomes displaceable to effect the deployment of the seat once all of the one or more retainable portions become disposed in their respective released positions.

3. The downhole tool as claimed in claim 1;

wherein the seat actuator is biased towards a seat actuation position for urging the deployment of the seat.

4. The downhole tool as claimed in claim 1;

wherein the key profile includes a pattern.

5. The downhole tool as claimed in claim 1;

wherein the displacement of the flow control member from a closed position to an open position effects uncovering of the port.

6. The downhole tool as claimed in claim 1;

wherein when the port is disposed in the closed condition, sealing, or substantial sealing, of fluid communication, between the port and the passage is effected; and wherein when the port is disposed in the open condition, fluid communication, between the port and the passage is effected.

7. A wellbore string comprising the downhole tool as claimed in claim 1.

8. A downhole tool comprising:

a housing;

a passage disposed within the housing;

a seat configured for deployment from a non-interfering position to a plug-receiving position for receiving a plug being deployed through the passage;

a seat actuator configured for displacement to a seat actuation position for effecting the deployment of the seat, wherein the seat actuator includes a plurality of retainable portions;

a seat actuator retainer;

a releasing actuator including a plurality of releasing actuator members, wherein each one of the releasing actuator members, independently, corresponds to a respective retainable portion;

wherein each one of the retainable portions, independently, is displaceable between a retained position and a released position, wherein, for each one of the retainable portions, in the retained position, the retainable portion is retained by the seat actuator retainer, and wherein, in the released position, the retainable portion is released from the seat actuator retainer; and wherein each one of the retainable portions, independently, is displaceable from its respective retained position to its respective released position, in response to transmission, by the respective releasing actuator member, of a force being applied from within the passage to the respective releasing actuator member;

such that the deployment of the seat from the non-interfering position to the plug-receiving position is prevented by the retention of at least one of the retainable portions by the seat actuator retainer;

and such that releasing of the seat actuator, with effect that the seat actuator becomes displaceable to the seat actuation position to effect the deployment of the seat from the non-interfering position to the plug-receiving position, is effected once all of the releasing actuator members become registered with a matching key of a plug being deployed through the passage, such that, for each one of the releasing actuator members, independently, a force, applied by the plug, is received and transmitted to the respective retainable portion such that displacement of the respective retainable portion is effected, and such that each one of retainable portions, independently, becomes disposed in its respective released position;

a port extending through the housing;

and a flow control member configured for displacement, relative to the port, in response to application of a sufficient net force effected by a fluid pressure differential that is created by supplying pressurized fluid to the passage while a plug is seated on the seat, wherein the displacement of the flow control member is from a closed position to an open position.

9. The downhole tool as claimed in claim 8;

wherein the seat actuator is biased towards the seat actuation position.

10. The downhole tool as claimed in claim 8;

wherein each one of the retainable portions, independently, is biased towards its respective retained position.

11. The downhole tool as claimed in claim 10;

wherein, for each one of the retainable portions, the biasing of the retainable portion also effects biasing of the respective releasing actuator member, such that each one of the releasing actuator members is positioned for registering with a matching key of a plug being deployed through the passage.

12. The downhole tool as claimed in claim 8;

wherein the plurality of releasing actuator members define a key profile configured for effecting the displacement of each one of the retainable portions, independently, in response to registration with a matching key of the plug being deployed through the passage.

13. The downhole tool as claimed in claim 8;

wherein the displacement of the flow control member from a closed position to an open position effects uncovering of the port.

14. The downhole tool as claimed in claim 8;

wherein when the port is disposed in the closed condition, sealing, or substantial sealing, of fluid communication, between the port and the passage is effected; and wherein when the port is disposed in the open condition, fluid communication, between the port and the passage is effected.

15. A wellbore string comprising the downhole tool as claimed in claim 8.

16. A process for supplying treatment fluid to a subterranean formation comprising:

deploying a first plug downhole through the wellbore string as claimed in claim 15, such that the first seat becomes deployed and the first plug becomes seated on the first seat;

supplying pressurized fluid uphole of the seated first plug such that the first flow control member becomes displaced to the open position;

supplying treatment fluid to the subterranean formation through the first port;

deploying a second plug downhole through the wellbore string, such that the second seat becomes deployed and the second plug becomes seated on the second seat;

supplying pressurized fluid uphole of the seated second plug such that the second flow control member becomes displaced to the open position; and supplying treatment fluid to the subterranean formation through the second port.

17. A kit for enabling fluid treatment of multiple zones within a well, comprising:

a first plug including a first key;

a second plug including a second key;

a first downhole tool, configured for incorporation within a wellbore string, and including:

a first housing;

a first passage disposed within the first housing;

a first seat configured for deployment to a plug-receiving position for receiving a first plug being deployed through the passage;

a first key profile for effecting actuation of the first seat to the plug-receiving position in response to registration of the first key profile with a matching key of the first plug being deployed through the passage;

a first port extending through the first housing;

and a first flow control member configured for displacement, relative to the first port, in response to application of a sufficient net force effected by a fluid pressure differential that is created by supplying pressurized fluid to the first passage while the first plug is seated on the first seat, wherein the displacement of the first flow control member is from a closed position to an open position; and a second downhole tool, configured for incorporation within a wellbore string, and including:

a second housing;

a second passage disposed within the second housing;

a second seat configured for deployment to a plug-receiving position for receiving a second plug being deployed through the passage;

a second key profile for effecting actuation of the second seat to the plug-receiving position in response to registration of the second key profile with a matching key of the second plug being deployed through the passage;

a second port extending through the second housing; and a second flow control member configured for displacement, relative to the second port, in response to application of a sufficient net force effected by a fluid pressure differential that is created by supplying pressurized fluid to the second passage while the second plug is seated on the second seat, wherein the displacement of the second flow control member is from a closed position to an open position;

wherein, for at least one of the first and second plugs, the key of one plug does not match the key profile to which the other plug is registerable with, such that, for at least one of the first and second plugs, the plug is deployable through the passage of the downhole tool with the non-matching key profile without effecting deployment of the seat of the downhole tool with the non-matching key profile.

18. The kit as claimed in claim 17;

wherein the first downhole tool further comprises:

a first seat actuator; and a first seat actuator retainer;

wherein the first seat actuator is releasable from retention by the first seat actuator retainer in response to the registration of the matching key of the first plug with the first key profile, such that the first seat actuator effects the deployment of the first seat;

and wherein the second downhole tool further comprises:

a second seat actuator; and a second seat actuator retainer;

wherein the second seat actuator is releasable from retention by the second seat actuator retainer in response to the registration of the matching key of the second plug with the second key profile, such that the second seat actuator effects the deployment of the second seat.

19. The kit as claimed in claim 18;

wherein the first seat actuator includes one or more first retainable portions;

and wherein the registration of the matching key of the first plug with the first key profile effects relative displacement between: (i) all of the one or more first retainable portions, and (ii) the first seat actuator retainer, such that the releasing of the first seat actuator from retention by the first seat actuator retainer is effected;

and wherein the second seat actuator includes one or more second retainable portions;

and wherein the registration of the matching key of the second plug with the second key profile effects relative displacement between: (i) all of the one or more second retainable portions, and (ii) the second seat actuator retainer, such that the releasing of the second seat actuator from retention by the second seat actuator retainer is effected.

20. The kit as claimed in claim 19;

wherein each one of the one or more first retainable portions, independently, is displaceable between a retained position and a released position, wherein, for each one of the one or more first retainable portions, in the retained position, the first retainable portion is retained by the first seat actuator retainer, and wherein, in the released position, the first retainable portion is released from the first seat actuator retainer;

such that the deployment of the first seat is prevented by the retention of at least one of the one or more first retainable portions by the first seat actuator retainer;

and such that the first seat actuator becomes released from retention by the first seat actuator retainer and becomes displaceable to effect the deployment of the first seat once all of the one or more first retainable portions become disposed in their respective released positions;

and wherein each one of the one or more second retainable portions, independently, is displaceable between a retained position and a released position, wherein, for each one of the one or more second retainable portions, in the retained position, the second retainable portion is retained by the second seat actuator retainer, and wherein, in the released position, the second retainable portion is released from the second seat actuator retainer;

such that the deployment of the second seat is prevented by the retention of at least one of the one or more second retainable portions by the second seat actuator retainer;

and such that the second seat actuator becomes released from retention by the second seat actuator retainer and becomes displaceable to effect the deployment of the second seat once all of the one or more second retainable portions become disposed in their respective released positions.

21. The kit as claimed in claim 19;

wherein the first key profile is configured to transmit, to the first retainable portions, a force applied by the plug while the registration of the matching key with the key profile is being effected;

and wherein the second key profile is configured to transmit, to the second retainable portions, a force applied by the plug while the registration of the matching key with the key profile is being effected.

22. The kit as claimed in claim 19;

wherein each one of the first retainable portions, independently, is biased towards its respective retained position;

and wherein each one of the second retainable portions, independently, is biased towards its respective retained position.

23. The kit as claimed in claim 19;

wherein the first key profile is configured to transmit, to the first retainable portions, a force applied by the first plug while the registration of the matching key of the first plug with the first key profile is being effected;

and wherein each one of the first retainable portions, independently, is biased towards its respective retained position;

and wherein, for each one of the first retainable portions, the biasing of the first retainable portion also effects biasing of the first key profile into a position for registering with a matching key of the first plug being deployed through the first passage;

and wherein the second key profile is configured to transmit, to the second retainable portions, a force applied by the second plug while the registration of the matching key of the second plug with the second key profile is being effected;

and wherein each one of the second retainable portions, independently, is biased towards its respective retained position;

and wherein, for each one of the second retainable portions, the biasing of the second retainable portion also effects biasing of the second key profile into a position for registering with a matching key of the second plug being deployed through the second passage.

24. The kit as claimed in claim 18;

wherein the first seat actuator is biased towards a seat actuation position for urging the deployment of the first seat;

and wherein the second seat actuator is biased towards a seat actuation position for urging the deployment of the second seat.

25. The kit as claimed in claim 17;

wherein the first key profile includes a first pattern;

and wherein the second key profile includes a second pattern; wherein the first pattern is different than the second pattern.

26. The kit as claimed in claim 17 wherein the displacement of the first flow control member from a closed position to an open position effects uncovering of the first port;

and wherein the displacement of the second flow control member from a closed position to an open position effects uncovering of the second port.

27. The kit as claimed in claim 17;

wherein when the first port is disposed in the closed condition, sealing, or substantial sealing, of fluid communication, between the first port and the first passage is effected;

and wherein when the first port is disposed in the open condition, fluid communication, between the first port and the first passage is effected;

and wherein when the second port is disposed in the closed condition, sealing, or substantial sealing, of fluid communication, between the second port and the second passage is effected;

and wherein when the second port is disposed in the open condition, fluid communication, between the second port and the second passage is effected.

28. The kit as claimed in claim 17;

wherein the first plug is configured such that, while the first plug is seated on the first seat, fluid flow, past the first plug, in a downhole direction, is prevented, or substantially prevented, such that the creation of the fluid pressure differential, for effecting the displacement of the first flow control member, is effected;

and wherein the second plug is configured such that, while the second plug is seated on the second seat, fluid flow, past the second plug, in a downhole direction, is prevented, or substantially prevented, such that the creation of the fluid pressure differential, for effecting the displacement of the second flow control member, is effected.

29. The kit as claimed in claim 17;

wherein the first plug includes a selectively openable fluid passage for effecting fluid flow within the first passage, across the first plug, in an uphole direction, in response to a downhole fluid pressure, acting on the first plug, sufficiently exceeding an uphole fluid pressure, acting on the first plug;

and wherein the second plug includes a selectively openable fluid passage for effecting fluid flow within the second passage, across the second plug, in an uphole direction, in response to a downhole fluid pressure, acting on the second plug, sufficiently exceeding an uphole fluid pressure, acting on the second plug.

30. The kit as claimed in claim 29;

wherein the selectively openable fluid passage of the first plug includes a one-way valve;

and wherein the selectively openable fluid passage of the second plug includes a one-way valve.

31. A kit for enabling fluid treatment of multiple zones within a well, comprising:

a first plug including a first key;

a second plug including a second key;

a first downhole tool, configured for incorporation within a wellbore string, and including:

a first housing;

a first passage disposed within the first housing;

a first seat configured for deployment to a plug-receiving position for receiving a first plug being deployed through the first passage;

a first seat actuator configured for displacement to a seat actuation position for effecting the deployment of the first seat, wherein the first seat actuator includes a plurality of first retainable portions; a first seat actuator retainer;

a first releasing actuator including a plurality of first releasing actuator members, wherein each one of the first releasing actuator members, independently, corresponds to a respective first retainable portion;

wherein each one of the first retainable portions, independently, is displaceable between a retained position and a released position, wherein, for each one of the first retainable portions, in the retained position, the first retainable portion is retained by the first seat actuator retainer, and wherein, in the released position, the first retainable portion is released from the first seat actuator retainer;

and wherein each one of the first retainable portions, independently, is displaceable from its respective retained position to its respective released position, in response to transmission, by the respective first releasing actuator member, of a force being applied from within the first passage to the respective first releasing actuator member;

such that the deployment of the first seat is prevented by the retention of at least one of the first retainable portions by the first seat actuator retainer;

and such that releasing of the first seat actuator, with effect that the first seat actuator becomes displaceable to the seat actuation position to effect the deployment of the first seat, is effected once all of the first releasing actuator members become registered with a matching key of a first plug being deployed through the first passage, such that, for each one of the first releasing actuator members, independently, a force, applied by the first plug, is received and transmitted to the respective first retainable portion such that displacement of the respective first retainable portion is effected, and such that each one of first retainable portions, independently, becomes disposed in its respective released position;

a first port extending through the first housing; and a first flow control member configured for displacement, relative to the first port, in response to application of a sufficient net force effected by a fluid pressure differential that is created by supplying pressurized fluid to the first passage while a first plug is seated on the first seat, wherein the displacement of the first flow control member is from a closed position to an open position;

and a second downhole tool, configured for incorporation within a wellbore string, and including:

a second housing;

a second passage disposed within the second housing;

a second seat configured for deployment to a plug-receiving position for receiving a second plug being deployed through the second passage;

a second seat actuator configured for displacement to a seat actuation position for effecting the deployment of the second seat, wherein the second seat actuator includes a plurality of second retainable portions;

a second seat actuator retainer;

a second releasing actuator including a plurality of second releasing actuator members, wherein each one of the second releasing actuator members, independently, corresponds to a respective second retainable portion;

wherein each one of the second retainable portions, independently, is displaceable between a retained position and a released position, wherein, for each one of the second retainable portions, in the retained position, the second retainable portion is retained by the second seat actuator retainer, and wherein, in the released position, the second retainable portion is released from the second seat actuator retainer;

and wherein each one of the second retainable portions, independently, is displaceable from its respective retained position to its respective released position, in response to transmission, by the respective second releasing actuator member, of a force being applied from within the second passage to the respective second releasing actuator member;

such that the deployment of the second seat is prevented by the retention of at least one of the second retainable portions by the second seat actuator retainer;

and such that releasing of the second seat actuator, with effect that the second seat actuator becomes displaceable to the seat actuation position to effect the deployment of the second seat, is effected once all of the second releasing actuator members become registered with a matching key of a second plug being deployed through the second passage, such that, for each one of the second releasing actuator members, independently, a force, applied by the second plug, is received and transmitted to the respective second retainable portion such that displacement of the respective second retainable portion is effected, and such that each one of second retainable portions, independently, becomes disposed in its respective released position;

a second port extending through the second housing; and a second flow control member configured for displacement, relative to the second port, in response to application of a sufficient net force effected by a fluid pressure differential that is created by supplying pressurized fluid to the second passage while a second plug is seated on the second seat, wherein the displacement of the second flow control member is from a closed position to an open position;

wherein, for at least one of the first and second plugs, the key of one plug does not match the key profile to which the other plug is registerable with, such that, for at least one of the first and second plugs, the plug is deployable through the passage of the downhole tool with the non-matching key profile without effecting deployment of the seat of the downhole tool with the non-matching key profile.

32. The kit as claimed in claim 31;

wherein the first seat actuator is biased towards the seat actuation position;

and wherein the second seat actuator is biased towards the seat actuation position.

33. The kit as claimed in claim 31;

wherein each one of the first retainable portions, independently, is biased towards its respective retained position;

and wherein each one of the second retainable portions, independently, is biased towards its respective retained position.

34. The kit as claimed in claim 31;

wherein, for each one of the first retainable portions, the biasing of the first retainable portion also effects biasing of the respective first releasing actuator member, such that each one of the first releasing actuator members is positioned for registering with a matching key of a first plug being deployed through the first passage;

and wherein, for each one of the second retainable portions, the biasing of the second retainable portion also effects biasing of the respective second releasing actuator member, such that each one of the second releasing actuator members is positioned for registering with a matching key of a second plug being deployed through the second passage.

35. The kit as claimed in claim 31;

wherein the plurality of first releasing actuator members define a first key profile configured for effecting the displacement of each one of the first retainable portions, independently, in response to registration with a matching key of the first plug being deployed through the first passage;

and wherein the plurality of second releasing actuator members define a second key profile configured for effecting the displacement of each one of the second retainable portions, independently, in response to registration with a matching key of the second plug being deployed through the second passage.

36. The kit as claimed in claim 31;

wherein the displacement of the first flow control member from a closed position to an open position effects uncovering of the first port;

and wherein the displacement of the second flow control member from a closed position to an open position effects uncovering of the second port.

37. The kit as claimed claim 31;

wherein when the first port is disposed in the closed condition, sealing, or substantial sealing, of fluid communication, between the first port and the first passage is effected;

and wherein when the first port is disposed in the open condition, fluid communication, between the first port and the first passage is effected;

and wherein when the second port is disposed in the closed condition, sealing, or substantial sealing, of fluid communication, between the second port and the second passage is effected;

and wherein when the second port is disposed in the open condition, fluid communication, between the second port and the second passage is effected.

38. The kit as claimed in claim 31;

wherein the first plug is configured such that, while the first plug is seated on the first seat, fluid flow within the first passage, past the first plug, in a downhole direction, is prevented, or substantially prevented, such that the creation of the fluid pressure differential, for effecting the displacement of the first flow control member, is effected and wherein the second plug is configured such that, while the second plug is seated on the second seat, fluid flow within the second passage, past the second plug, in a downhole direction, is prevented, or substantially prevented, such that the creation of the fluid pressure differential, for effecting the displacement of the second flow control member, is effected.

39. The kit as claimed in claim 31;

wherein the first plug includes a selectively openable fluid passage for effecting fluid flow within the first passage, across the first plug, in an uphole direction, in response to a downhole fluid pressure, acting on the first plug, sufficiently exceeding an uphole fluid pressure, acting on the first plug;

and wherein the second plug includes a selectively openable fluid passage for effecting fluid flow within the second passage, across the second plug, in an uphole direction, in response to a downhole fluid pressure, acting on the second plug, sufficiently exceeding an uphole fluid pressure, acting on the second plug.

40. The kit as claimed in claim 31;

wherein the selectively openable fluid passage of the first plug includes a one-way valve;

and wherein the selectively openable fluid passage of the second plug includes a one-way valve.

* * * * *